US005515917A

United States Patent [19]

Watkins et al.

[11] Patent Number: 5,515,917

[45] Date of Patent: May 14, 1996

[54] WELL APPARATUS

[75] Inventors: Bruce J. Watkins, Houston; Gerald W. Crotwell, Sugar Land, both of Tex.

[73] Assignee: Dril-Quip, Inc., Houston, Tex.

[21] Appl. No.: 322,067

[22] Filed: Oct. 12, 1994

[51] Int. Cl.[6] ..... E21B 43/00

[52] U.S. Cl. ..... 166/208; 166/217

[58] Field of Search ..... 166/382, 206, 166/208, 217, 344, 348, 368

[56] References Cited

U.S. PATENT DOCUMENTS

| | | |
|---|---|---|
| 2,778,433 | 1/1957 | Brown . |
| 3,287,030 | 11/1966 | Crain et al. . |
| 3,357,486 | 12/1967 | Brown . |
| 3,404,736 | 10/1968 | Nelson et al. . |
| 3,457,992 | 7/1969 | Brown . |
| 3,461,958 | 8/1969 | Brown . |
| 3,468,558 | 9/1969 | Ahlstone . |
| 3,528,686 | 9/1970 | Nelson . |
| 3,540,533 | 11/1970 | Morrill . |
| 3,661,206 | 5/1972 | Putch et al. . |
| 3,688,841 | 9/1972 | Baugh . |
| 3,800,869 | 4/1974 | Herd et al. . |
| 4,046,405 | 9/1977 | Bonds . |
| 4,408,783 | 10/1983 | Gruller . |
| 4,416,472 | 11/1983 | Fowler et al. . |
| 4,554,976 | 11/1985 | Hynes et al. . |
| 4,995,464 | 2/1991 | Watkins et al. . |
| 5,026,097 | 6/1991 | Reimert . |
| 5,195,586 | 3/1993 | Gambertoglio . |
| 5,299,642 | 4/1994 | Nelson et al. ..... 166/308 |

OTHER PUBLICATIONS

4–Page Brochure entitled "Emergency Backout Sub", Dril–Quip, Inc. (1991).

*Primary Examiner*—William P. Neuder

*Attorney, Agent, or Firm*—Frank S. Vaden, III; Marvin B. Eickenroht; Jennings B. Thompson

[57] ABSTRACT

There is disclosed well apparatus wherein a so-called "back-out sub" connected by right-hand threads at its lower end to a lower well pipe has both left-hand threads thereabout for connection with left-hand threads on the lower end of one upper tubular member to permit it to be released and raised from the lower tubular member, in response to right hand rotation of the upper tubular member, and right-hand threads for connection with right-hand threads on the lower end of another upper tubular member for use in tying the lower tubular member and thus the lower well pipe back to the head of the well in response to right-hand rotation.

13 Claims, 7 Drawing Sheets

FIG. 3A
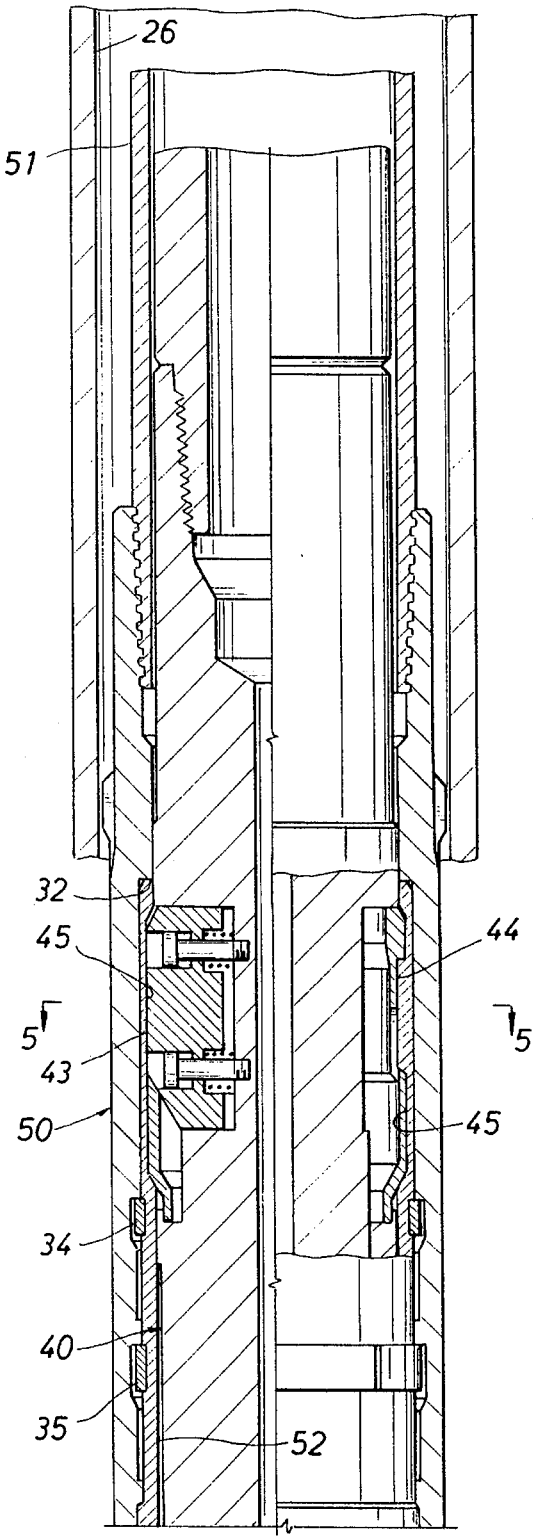
FIG. 3B
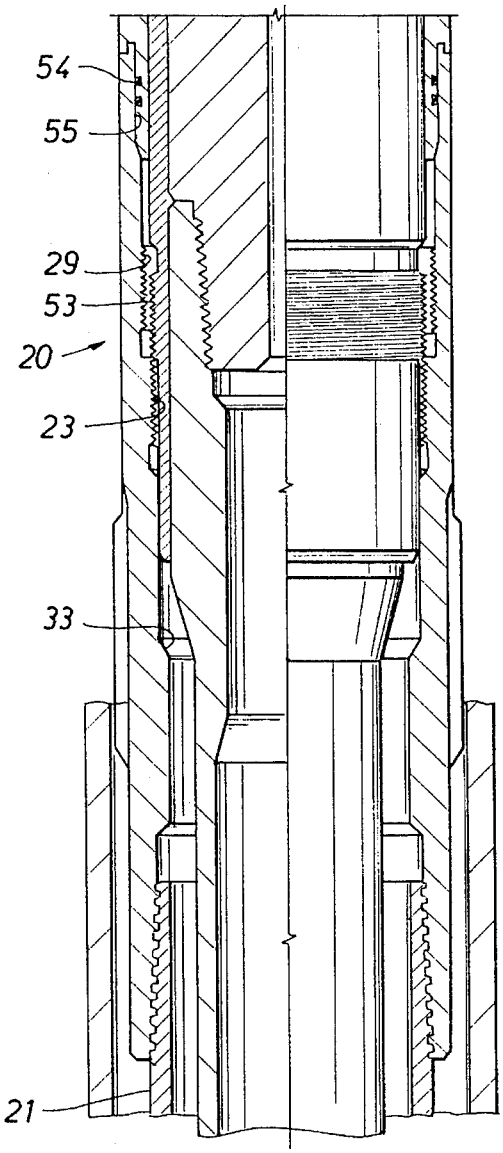
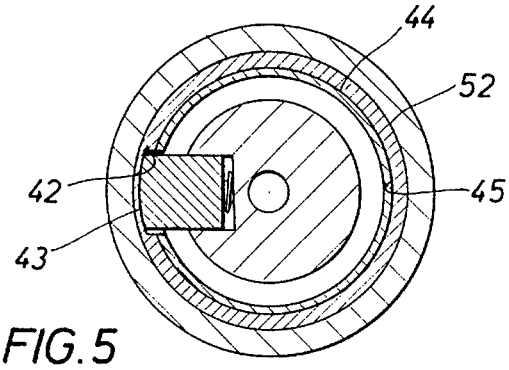
FIG. 5

WELL APPARATUS

This invention relates generally to well apparatus in which the lower end of an upper tubular member connected to an upper well pipe is to be connected to or disconnected from the upper end of a lower tubular member connected at its lower end to a lower well pipe. More particularly, it relates to improved apparatus of this type in which the lower tubular member is a so-called "backout sub" connected, at its lower end, usually by right-hand threads, to the lower well pipe and having both left-hand threads thereabout for connection with threads on the lower end of one upper tubular member which may be of opposite hand to those of the lower to permit it to be released and raised from the lower tubular member, in response to right hand rotation of the upper tubular member, and threads of the same hand for connection with right-hand threads on the lower end of another upper tubular member for use in tying the lower tubular member and thus the lower well pipe back to the head of the well.

In the drilling and completion of an oil or gas well, a casing string may become "stuck" or wedged in the well bore before it reaches the desired depth. As a result, the upper end of the string is not at the proper elevation to permit it to be suspended from the wellhead. This then requires expensive and time-consuming remedial procedures in order to sever the string above the stuck string portion in order to prepare the upper end of the stuck portion for landing in the wellhead.

Also, even if the casing string is lowered to full depth and properly suspended from the wellhead, a portion thereof may be perforated or otherwise damaged to the extent that it must be replaced. This also requires expensive and time-consuming remedial procedures in severing the string below the damaged area and replacing it with another portion to permit the remaining portion to be tied back to the wellhead.

The assignee of the present application manufactures and sells equipment which greatly simplifies these remedial procedures by installing the aforementioned backout sub at a level in the casing string either above the portion most likely to be stuck or beneath the portion most likely to be damaged. Since the joints of casing making up the string are usually made up with right-hand threads, the upper portion of the casing may be rotated to the right to disconnect left-hand threads of the running tool from those of the sub without disconnecting other joints of the casing, and the replacement portion of the casing may be rotated to the right to connect the right-hand threads of the tieback tool to those of the sub, again without disconnecting other joints of the casing.

However, when a backout sub is lowered to a significant depth, say greater than 1,000 feet, particularly in a deviated well bore, it is difficult if not impossible to transmit sufficient torque through the upper portion of the relatively thin-walled casing string to make up and break out the threads. It is therefore an object of this invention to provide apparatus of this type in which the upper portion of the casing may be disconnected from and the replacement portion connected to the backout sub without having to rotate the casing string.

In the completion of a subsea well, it is often the practice to suspend an inner casing string from an outer casing string at the "mudline" by means of a hanger on the inner casing lowerable into a supported position within the outer casing supported from a conductor extending into the well bore. The casing strings are tied back to a wellhead housing having a bore in which a hanger or hangers for one or more tubing strings are supported to suspend them within the inner casing string. Upon landing of the tubing hangers, a blowout preventer above the housing is replaced by a Christmas tree which is lowered onto the housing by means of a guide system which predetermines its rotational orientation with respect to the housing and thus the casing strings connected to it. The upper end of each tubing string must be vertically aligned with a corresponding passageway of the tree as the latter is lowered onto the housing.

In many cases, such as the suspending of dual,parallel tubing strings, it is necessary that each tubing hanger be rotationally as well as vertically aligned with its corresponding passageway in the tree. For this purpose, it is common practice to provide a pin on one and a vertical slot on the other of the hanger and bore of the wellhead housing to receive the pin and thus rotationally orient the hanger as it is lowered into supported position in the housing bore. However, the mudline casing hanger at the upper end of the inner casing string which is to be tied back to the hanger in the wellhead housing, prior to running of the tubing strings, is normally connected to a housing in the outer casing string by a ratchet of some type which requires at least some rotation to secure it to the housing. Typical equipment of this type is shown, for example, in U.S. Pat. No. 5,026,097, assigned to the assignee of the present application.

It is therefore a further object of this invention to provide apparatus of the type above described, including a backout sub, which may be used to permit the inner casing string to be lowered onto the mudline hanger by a running tool which may be disconnected therefrom, without disconnecting the lower end of the casing string suspended from the mudline hanger, and replaced by a tieback string to be lowered with the wellhead housing for connection to the mudline hanger without rotation of the mudline hanger.

This and other objects are accomplished in accordance with the illustrated and preferred embodiment of this invention, by well apparatus which includes, in addition to a lower tubular member or sub connectible at its lower end to a lower well pipe and having vertically spaced, right- and left-hand sets of threads within its bore, an upper tubular member connectible at its upper end to upper well and pipe, and having right-hand threads at its upper end, and means about the upper end of the lower member sub for sealably interfitting with means about the lower end of the upper tubular member when the members are moved into end-to-end relation. More particularly, a sleeve received within the bores of the upper and lower tubular members to form a continuation thereof is rotatable and vertically reciprocable with respect thereto, and has threads thereabout which permit it to be selectively connected to or disconnected from one set of threads of the lower tubular member as it is moved from one vertical position to another.

The apparatus further includes a torque tool adapted to be connected to a string of drill pipe for lowering through the well pipe into engagement with the sleeve in order to impart rotation thereto, whereby the sleeve may be connected to or disconnected said one set of threads, and out of engagement with the sleeve to permit it to be raised therefrom when the sleeve has been so moved. Thus, the necessary torque is transmitted through the drill pipe rather than the casing or other well pipe less able to transmit the torque. More particularly, the sleeve has an essentially vertical slot about its bore and the torque tool has a lug slidably engageable with and disengageable from within the slot of the sleeve in response to its vertical movement.

The threads on the sleeve are left hand and the one set of threads of the lower tubular member are left hand to permit disconnection of the sleeve in response to right-hand rotation. Alternatively, the threads of the sleeve are right hand and the one set of threads of the lower tubular member are right hand to permit connection of the sleeve in response to right-hand rotation. More particularly, however, in the preferred and illustrated embodiment of the invention, the apparatus includes both a first upper tubular member or running tool having right-hand threads at its upper end for connection to a first upper well pipe, and a first sleeve carried within the bore of the first upper tubular member having left-hand threads thereabout connectible to the left-hand threads of the lower tubular member, when in its lower position, but adapted to be disconnected therefrom, upon raising of the tool and rotation of the first sleeve in a right-hand direction, as well as a second upper tubular member having right-hand threads at its upper end for connection to a second upper well pipe, and a second sleeve carried within the bore of the tieback tool having right-hand threads thereabout connectible to the right-hand threads of the lower tubular member upon lowering of the tool and rotation of the second sleeve in a right-hand direction to move it from its upper to its lower position. In this preferred embodiment, both tools are of the same construction, and each of the first and second sleeves is releasable from the tool in which it is carried.

As illustrated, in a first embodiment of the invention, the lower tubular member comprises a back out sub connectible to the upper end of a lower portion of a casing string, the running tool is connectible to the lower end of an upper portion of the casing string, and the first sleeve is carried within the running tool so that it may be raised with the running tool from the sub and upper portion of the casing string. More particularly, the tieback tool is connectible to the lower end of a replacement upper portion of the casing string, and the second sleeve is carried within the tieback tool so that it may be moved from its upper to its lower position in order to tie the lower portion of the casing string back to the wellhead through replacement string.

In accordance with another embodiment of the invention wherein the lower tubular member is a mudline hanger having a backout sub with right-hand threads at its lower end connectible to an inner casing string to suspend it within an outer casing string running tool as it is lowered into a subsea well bore, connectible at its lower end to the left-hand threads of the sub so that it may be raised from the hanger. More particularly, the right-hand threads of a tieback tool are connectible to the lower end of a tieback pipe string which is adapted to be connected to a wellhead housing at the water surface in which a tubing hanger for suspending one or more tubing strings within the inner casing string is to be supported in a predetermined, rotational orientation, and a means about its lower end is sealably interfittable with means about the upper end of the mudline hanger, when lowered into end-to-end relation therewith. A sleeve is carried within the tieback tool for relative rotation and vertical reciprocation with respect thereto between upper and lower positions and has right-hand threads thereabout connectible to the right-hand threads of the mudline hanger, upon lowering of the tieback tool into engagement therewith and rotation of the sleeve in a right-hand direction to move it from its upper to its lower position. Thus, the tieback string may be tied back without rotating the hanger sub and thus its connection to the mudline housing.

In the drawings, wherein like reference characters are used throughout to designate like parts:

FIGS. 1A and 1B are vertical sectional views, partly in elevation, of apparatus constructed in accordance with the first described embodiment of the present invention, wherein an upper portion of a casing string is to be replaced by another portion, and showing the running tool at the lower end of the upper portion connected by the first sleeve to the backout sub at the upper end of the lower portion of the casing string so as to lower the lower portion of the casing string into the well bore;

FIGS. 3A and 3B are views similar to FIGS. 1A and 1B and FIGS. 2A and 2B, but showing the tieback tool suspended from the lower end of the replacement string and with the second sleeve carried thereon in its upper position and a torque tool disposed with the second sleeve in position to rotate it into connection with the backout sub;

FIG. 5 is a cross-sectional view of the apparatus, as seen along broken lines 5—5 of FIG. 3A.

Figure 6:
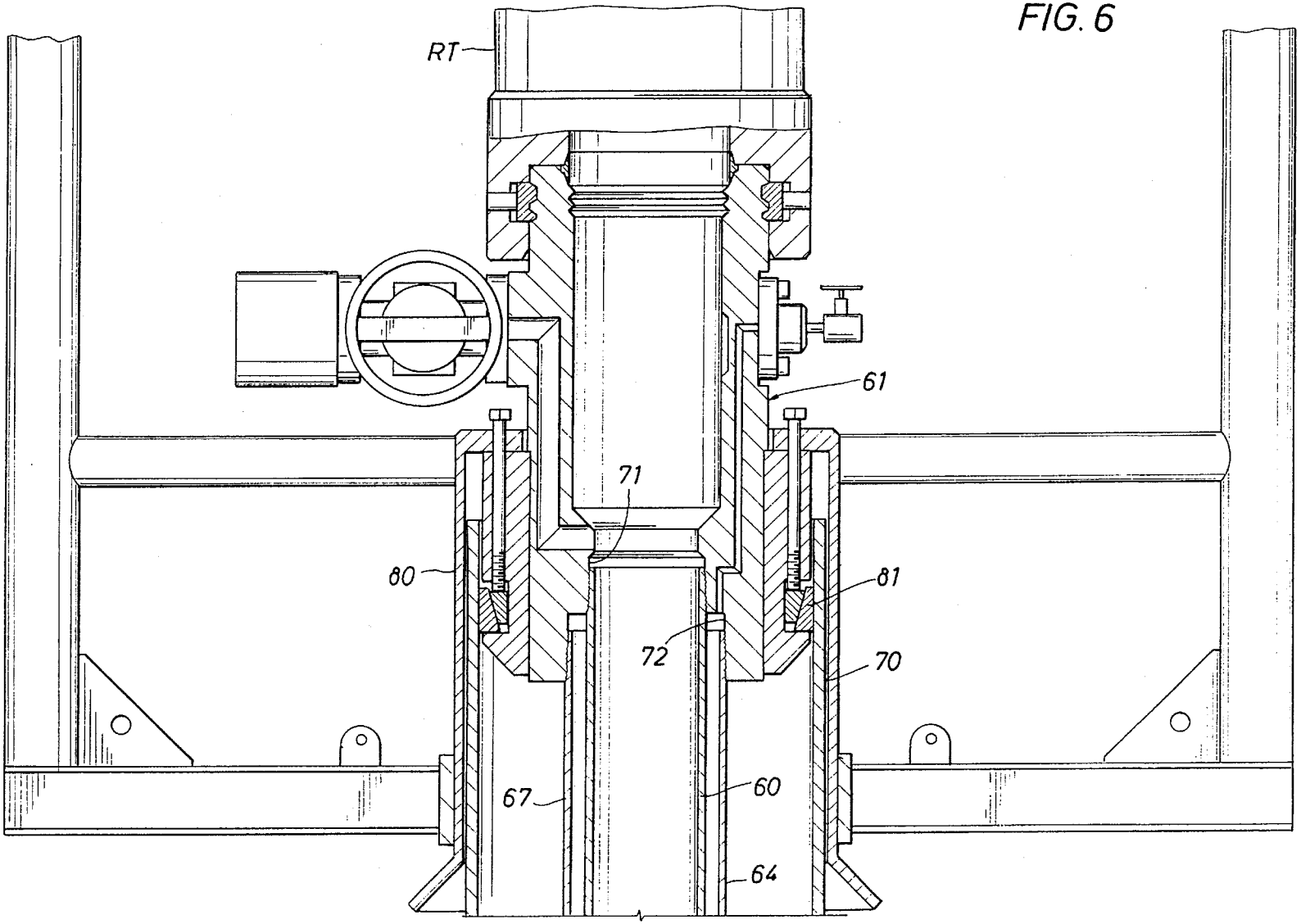
FIG. 6 is a vertical sectional view of apparatus constructed in accordance with the second described embodiment of the invention wherein a wellhead housing has been guidably lowered onto and rotationally fixed with respect to the upper end of a conductor pipe of a subsea well so as to suspend casing strings connected thereto within the well bore.
Figure 7:
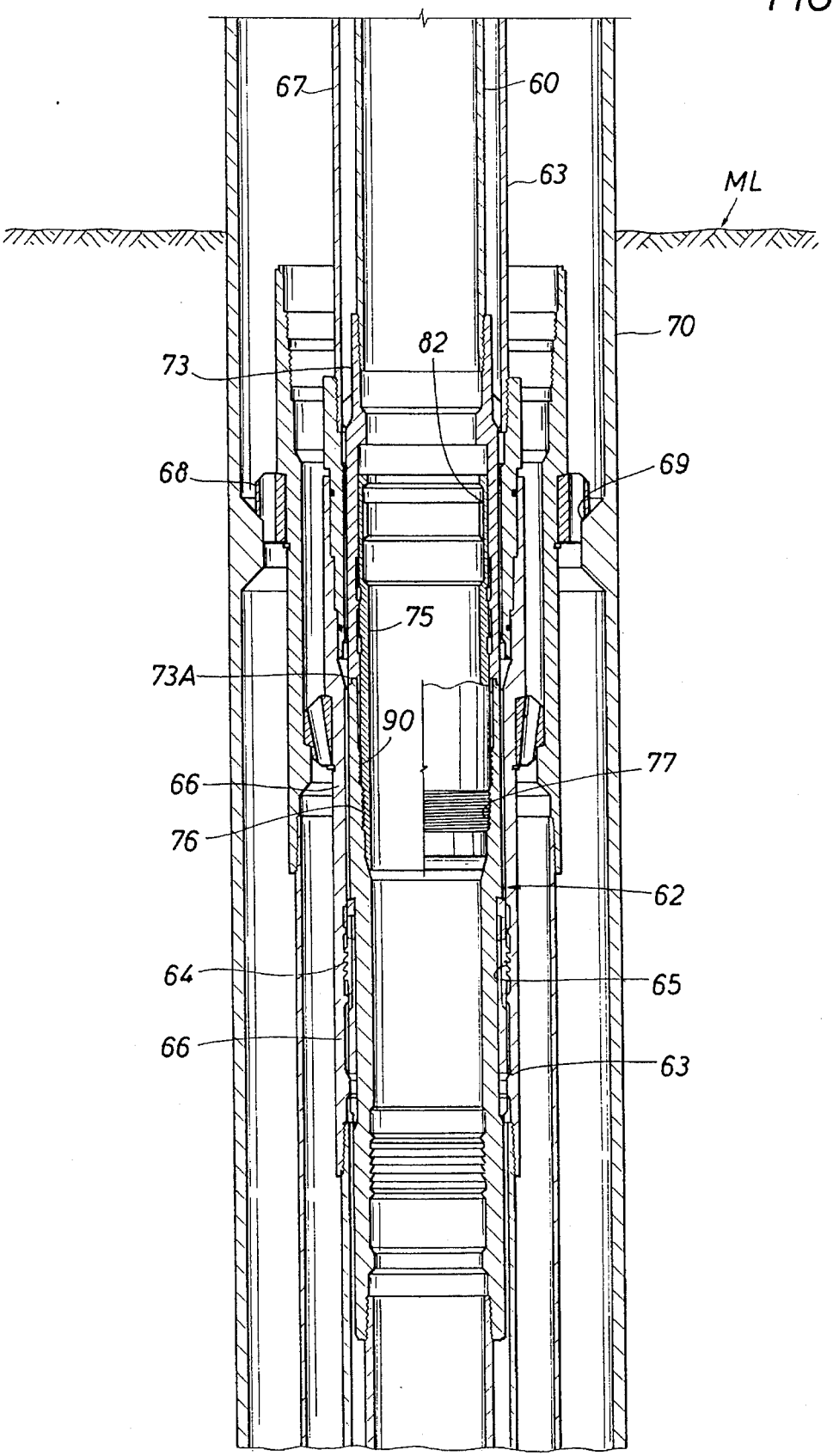
Figure 8:
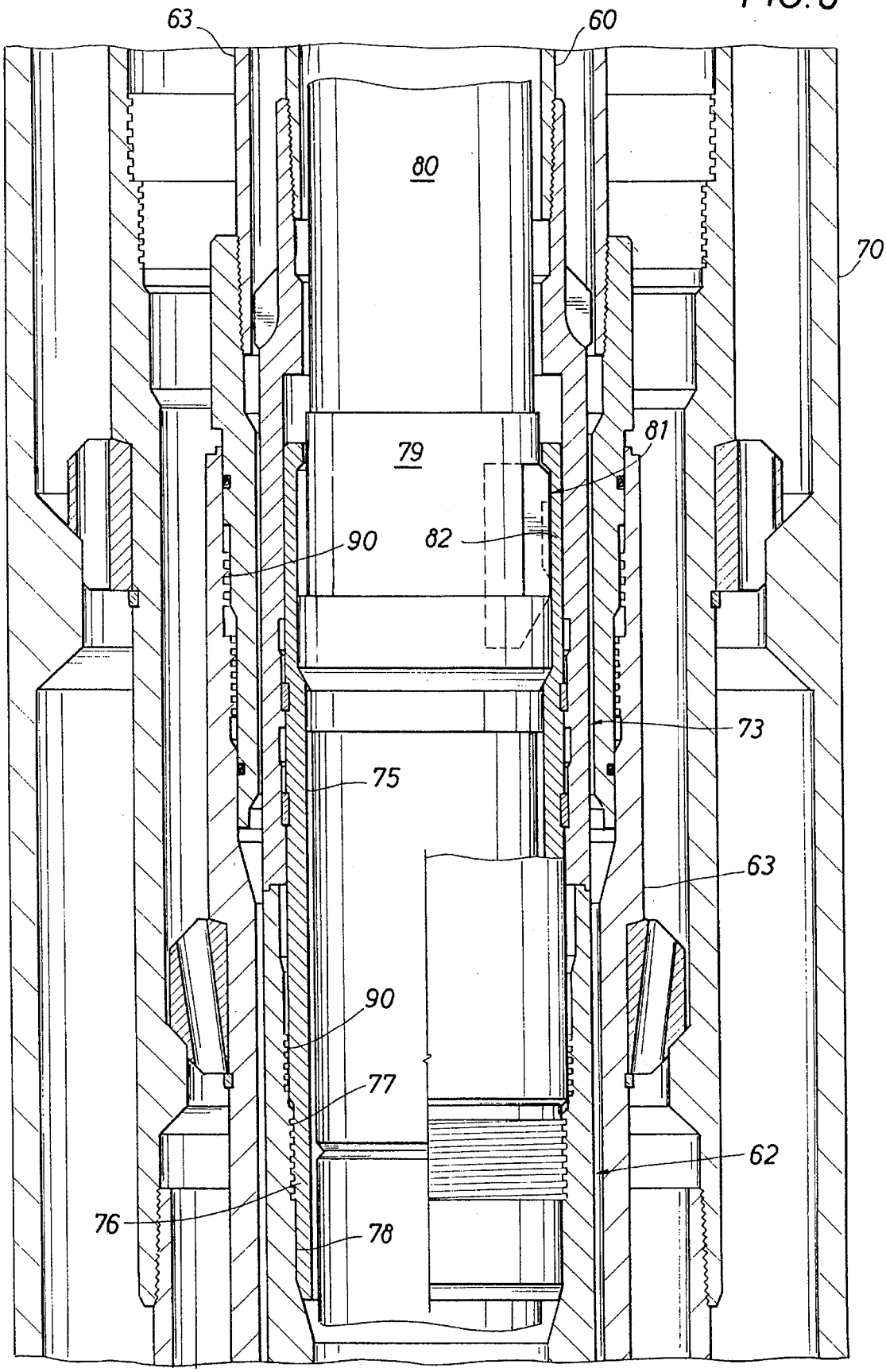

FIG. 7 is a vertical sectional view of the lower end of the apparatus of FIG. 6 showing a mudline hanger at the upper end of an inner casing string which has been previously lowered into landed position in an outer casing string by means of a running tool on a running string and upon replacement of the running string with a tieback tool and a second sleeve suspended from a tieback string to connect the string to the hanger in response to right-hand rotation and lowering of the second sleeve; and FIG. 8 is an enlarged vertical sectional view of a mid portion of the apparatus shown in FIG. 7 showing the details of the connection of the tieback tool to the upper end of the mudline hanger.

With reference now to the details of the above described drawings, the apparatus constructed in accordance with the first described embodiment of the present invention is shown in FIGS. 1 to 4 to include a backout sub 20 threadedly connected at its lower end to a lower portion 21 of a casing string and having left-hand and right-hand threads 22 and 23, respectively, about an enlarged diameter portion of its bore. As shown in FIGS. 1A and 1B, the apparatus also includes a running tool 24 which is suspended from the lower end of an upper portion 25 of the casing string and connected, in a manner to be described, to the backout sub to permit the lower casing portion to be lowered with the upper casing portion into a well bore such as the inner diameter of an outer casing 26.

As previously described, this invention contemplates that the casing string may have become stuck in the well bore, before being lowered to full depth, and at a location beneath the backout sub. Alternatively, even though lowered to full depth, and subsequently cemented in the well bore, the casing may become perforated or otherwise damaged above the sub. In either event, it then becomes necessary to remove the upper portion of the casing string from its connection through the running tool to the lower portion thereof in order to tie the lower portion back to the wellhead by a replacement casing string portion.

As shown, the running tool 24 has its lower end vertically slidably engaged with the sub to form a seal therebetween, as it is lowered onto the backout sub. Thus, the upper end of the bore of the backout sub has an enlarged diameter 27 adapted to receive an extension 28 on the lower end of the running tool which carries seal rings 29 about it for engaging the enlarged diameter bore portion 27.

As previously described, the running tool is indirectly connected to the backout sub by means of a first sleeve 30 which is carried within the bore of the running tool for rotation as well as vertical reciprocation with respect thereto. More particularly, the first sleeve has left-hand threads 31 thereabout which, when the running tool is landed on the backout sub, are connected to the left-hand threads 22 of the sub as the tool is rotated to the left to lower the sleeve to its lower position in which its lower end abuts against shoulder 33 in the bore of the sub. When these threads are backed off from the threads on the backout tool, the first sleeve is raised to the upper position shown in FIGS. 2A and 2B in which its upper end engages a downwardly facing stop shoulder 32 in the bore of the running tool.

The first sleeve is carried for rotation as well as vertical reciprocation with respect to the running tool by a pair of split rings 34 and 35 which are mounted within grooves about the sleeve for extending into upper and lower recesses 36 and 37 in the bore of the running tool. As shown, these recesses are of sufficient length as to permit the rings to move between engagement with their upper and lower ends as the sleeve is moved between its upper and lower positions.

Figure 1A:
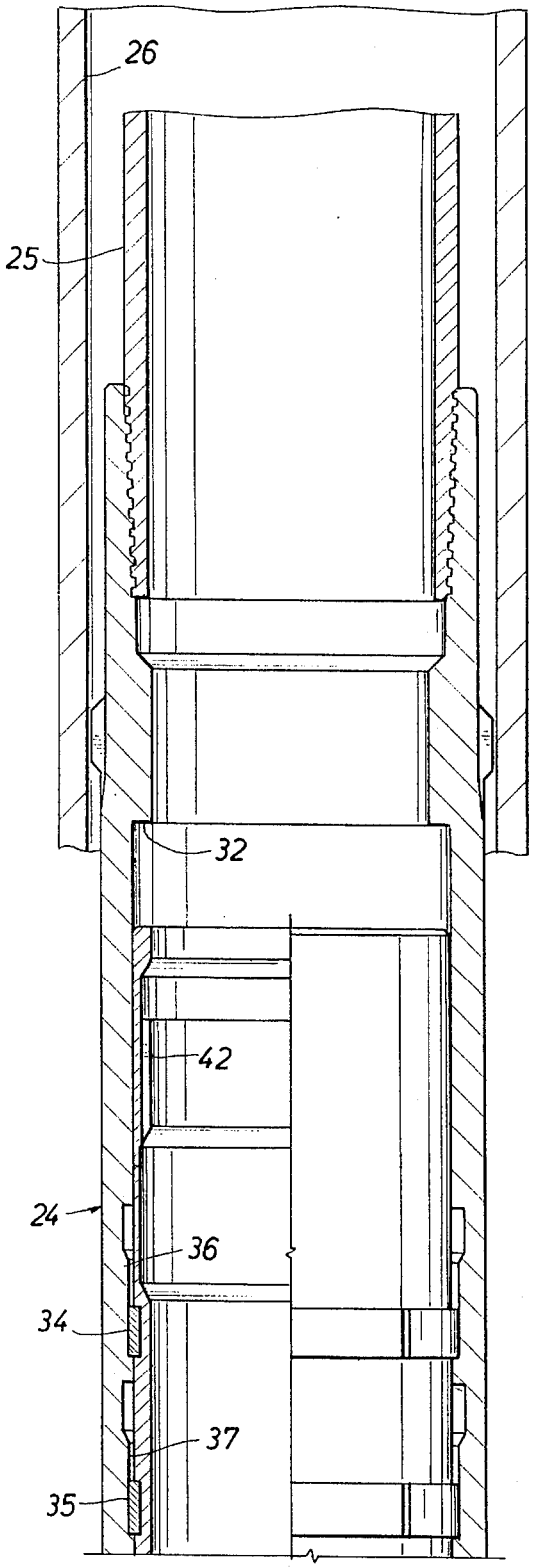
Figure 1B:
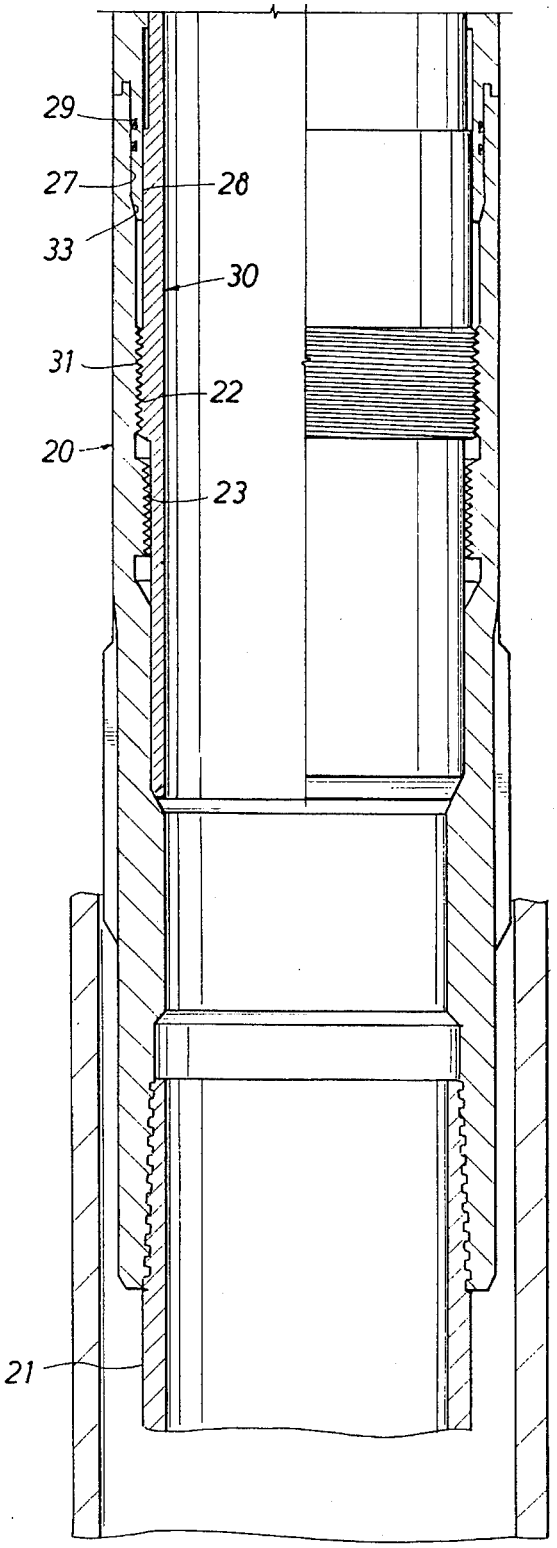

As will be appreciated, in use, the backout sub, first sleeve, and running tool are preassembled in the position shown in FIGS. 1A and 1B to permit the lower portion of the casing string to be lowered into the well bore with the upper portion thereof. When it is then necessary to back out the upper portion of the casing string, a torque tool, indicated in its entirety by reference character 40, is lowered on a string of drill pipe 41 into engagement with the sleeve in order to impart right-hand rotation to the sleeve for disconnecting its threads 31 from the threads 22 of the backout sub. For this purpose, an essentially vertical slot 42 is formed in an upper portion of the bore of the first sleeve to closely receive an outwardly spring-pressed lug 43 carried by the torque tool when the lug is disposed opposite the slot.

The torque tool also carries a cage or key 44 thereabout which normally assumes an outer position to engage in a matching profile 45 in the bore of the sleeve, when the torque tool is lowered to a position opposite thereto. When the key is so engaged, a square shoulder on its upper end lands on a square shoulder in a raised portion of the bore of the sleeve in which the slot 42 is formed. As known in the art, the use of such a key enables the torque tool and lug to be selectively landed at the desired location and then easily raised from within the sleeve when they are forced to contract. As shown, the lug is received in a cavity 44A in the side of the body of the torque tool and extends into the slot through a recess in the key.

Figure 2A:
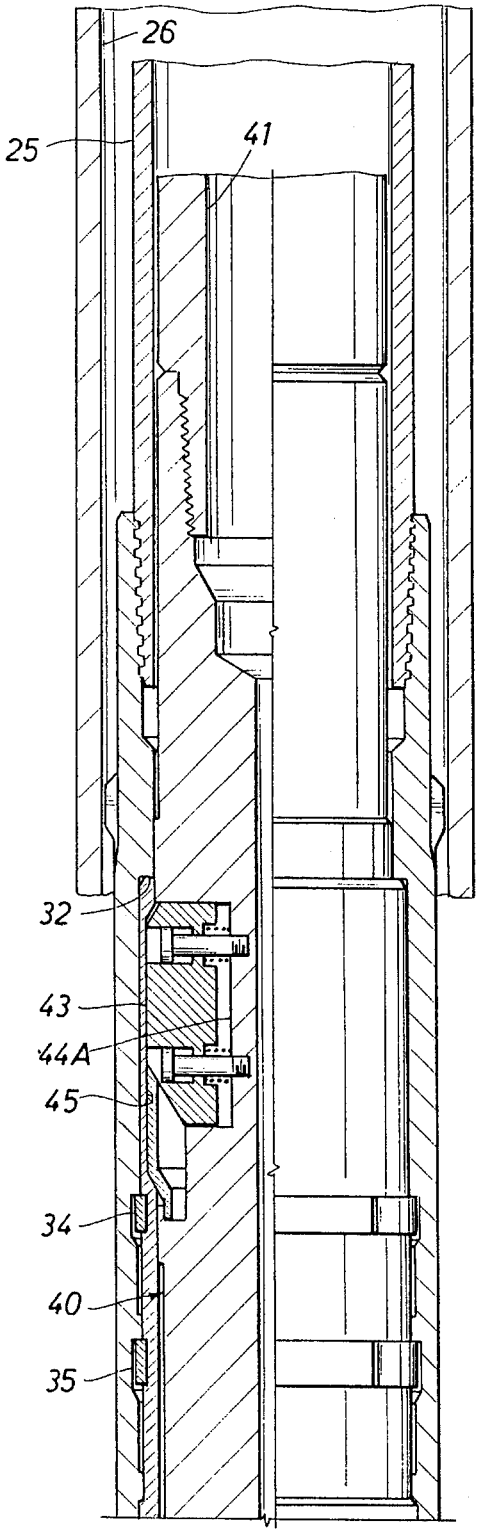
FIGS. 2A and 2B are views similar to FIGS. 1A and 1B, but upon lowering of the torque tool into the first sleeve to dispose a lug thereon within a slot in the first sleeve, so that, upon rotation of the torque tool in a right-hand direction, the sleeve is disconnected from the sub so that the sleeve to be raised with the running tool and upper portion of the string.
Figure 2B:
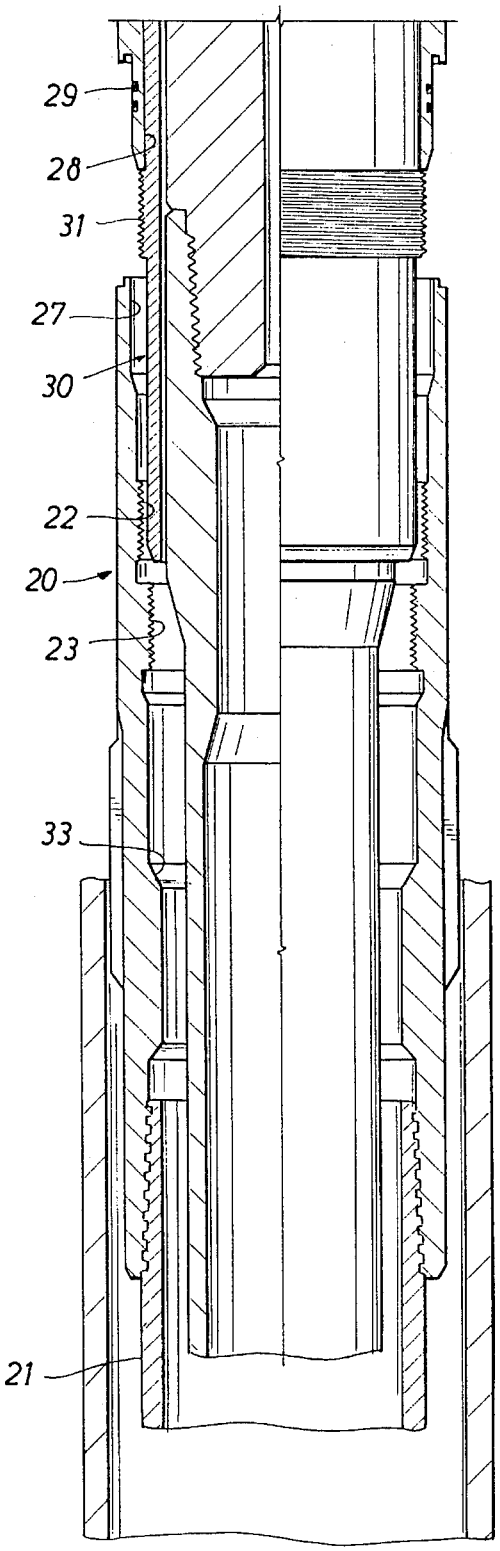

As previously described and as shown in FIGS. 2A and 2B, upon rotation of the drill pipe and thus the torque tool to the right, the first sleeve is in turn rotated to the right to disconnect its threads 31 from the threads 22 of the backout sub, whereby the sleeve together with the running tool and the upper portion of the casing string may be raised from the backout sub and lower portion of the casing string.

As illustrated in FIGS. 3A and 3B, when the lower casing portion 21 and backout sub 20 are to be tied back to the wellhead, a tieback tool 50, which may be identical to the running tool 24, is connected to the lower end of the replacement casing 51 for lowering into connection with the backout sub. As in the case of the running tool 24, the tieback tool 50 is lowered into vertically slidable engagement with the upper end of the backout sub for sealing with respect to it, and carries a second sleeve 52 having right-hand threads 53 for making up with right-hand threads 23 on the bore of the backout sub. Thus, as in the case of the running tool, the tieback tool 51 has a lower extension 54 sealably and slidably engaged with the enlarged diameter portion at the upper end of the backout sub, and the second sleeve 52 is carried within the tieback tool for relative rotation and vertical reciprocation with respect to it.

In the running-in position shown in FIGS. 3A and 3B, the second sleeve has been moved to its upper position where it engages the downwardly facing shoulder 32 of the tieback tool, the sleeve being releasably held in the upper position by means of the split rings 34 and 35 which have been moved into the enlarged upper ends of the recesses. A torque tool 40, which may also be identical in construction to the torque tool 40 used in backing the first sleeve off of the backout sub, is shown in FIGS. 3A and 3B to be lowered on drill pipe into engagement with the second sleeve in order to rotate it to the right and thus connect the threads 53 to the threads 23 of the backout sub. Thus, in a manner previously described, the lug 43 on the torque tool has moved outwardly into engagement with a slot 42 in the profile in the upper end of the second sleeve such that right-hand rotation may be imparted to the second sleeve to make up the threads.

Figure 4A:
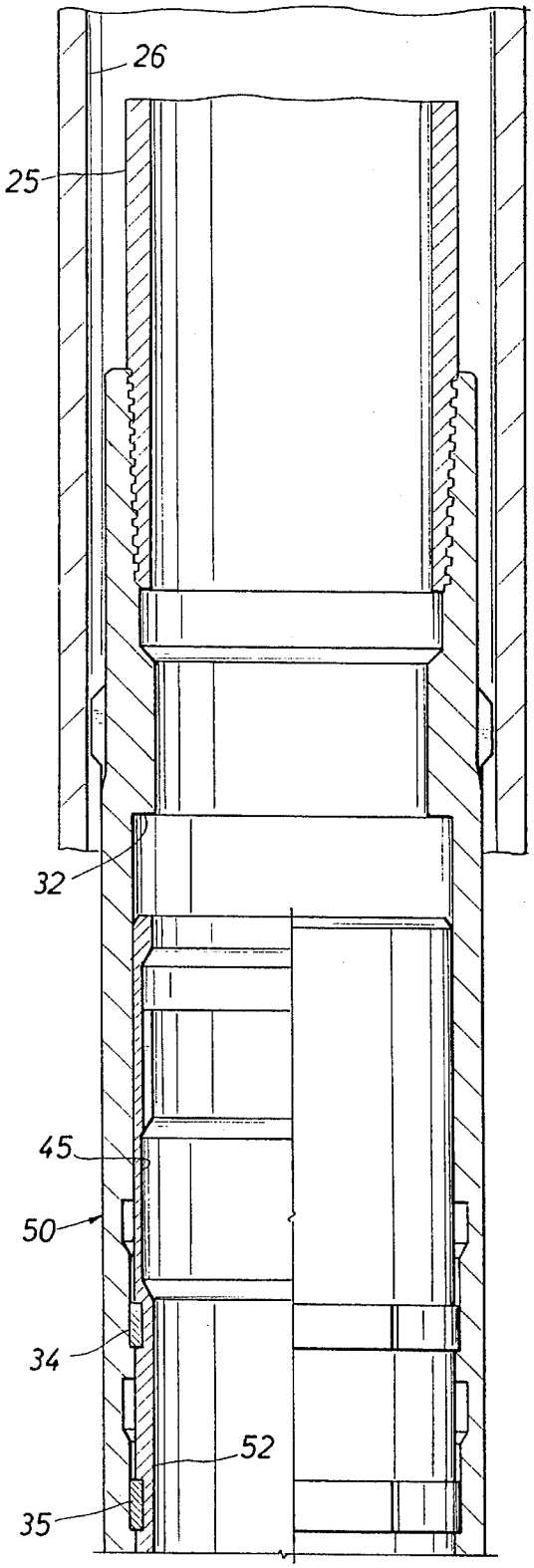
FIGS. 4A and 4B are still other views similar to FIGS. 1A and 1B, FIGS. 2A and 2B, and FIGS. 3A and 3B, but upon rotation of the second sleeve with the torque tool to threadedly connect its right-hand threads with the right-hand threads of the backout sub, and thus tie the lower portion of the casing string back to the wellhead, and following raising of the torque tool from within the sleeve.
Figure 4B:
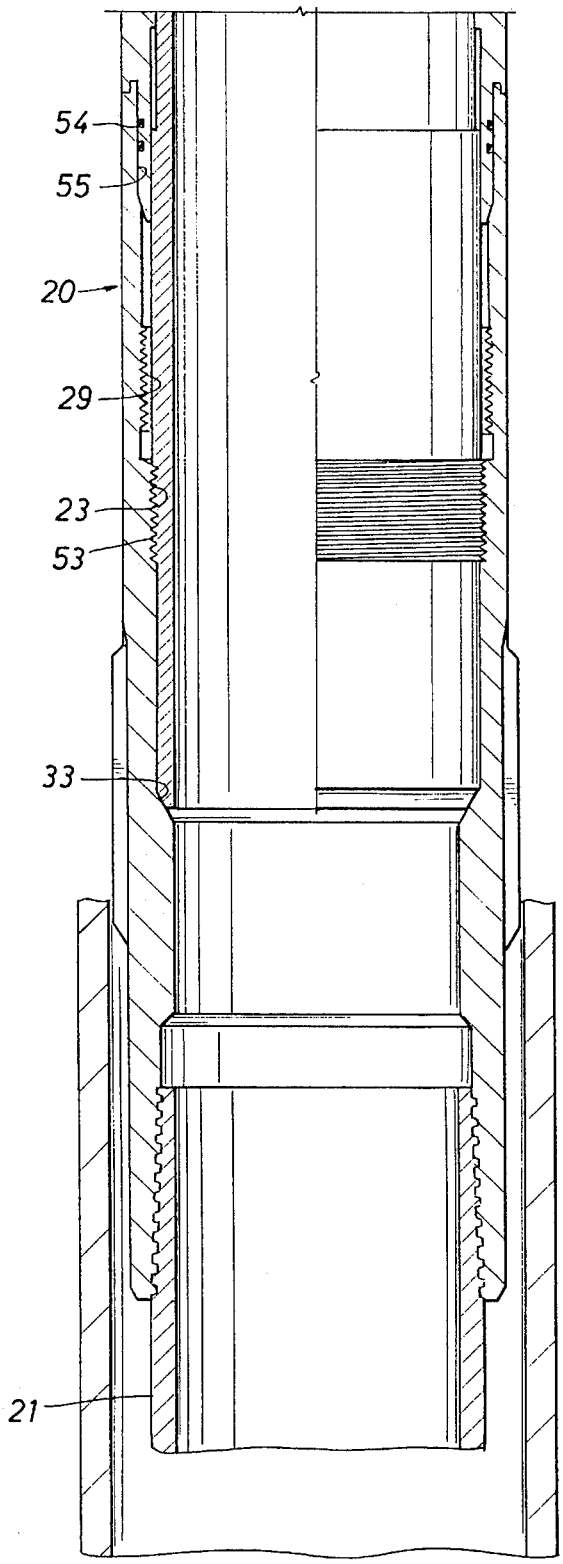

As the threads 53 and 23 are made up, in response to right-hand rotation of the sleeve, the sleeve moves downwardly from the upper position of FIGS. 3A and 3B to the lower positions of FIGS. 4A and 4B until the lower end of the sleeve lands on the shoulder 53 in the bore of the backout sub. At this time, of course, the drill pipe may be raised to release the lug and cage of the backout tool from the second sleeve and thereby permit retrieval of the torque tool, so that the bore of the casing string, including the replacement portion, are cleared for flow therethrough. The backout sub 20 will, of course, remain within the casing string, so as to permit the replacement casing portion itself to be replaced, if necessary.

As previously described, and as shown in FIGS. 6 to 8, the well apparatus constructed in accordance with the second embodiment of the invention is useful in connecting the lower end of a tieback casing string 60 suspended from a subsea wellhead 61 to a mudline casing hanger 62 supported within an outer casing 63 at the mudline ML (see FIG. 7) of the well. More particularly, as shown in detail in FIG. 7, and more particularly in U.S. Pat. No. 5,026,097, previously referred to, the mudline hanger 62 is supported by means of a ratchet-type latch 64 expandable into grooves 65 formed within the bore of housing 66 connected as a part of the outer casing 67 whose upper end is in turn suspended from an enlarged bore of the wellhead housing 61 in surrounding relation to the inner casing 60. The mudline housing 66 is in turn supported by means of a collar 68 about it which is landed upon a shoulder 69 of the outer conductor 70 disposed within the well bore and extends upwardly to a position for supporting the wellhead housing 61, as will be described.

More particularly, the upper ends of each of the inner and outer casing strings 60 and 67 are connected to bores 71 and 72, respectively, of the housing with the annular space between each of the inner and outer casings being connected by a passageway at its upper end to suitable valving on the wellhead housing, all in a manner well known in the art. The lower end of the inner casing string is connected by right-hand threads to the upper end of a tieback tool 73 whose lower end is sealably interfitted with the upper end of the mudline hanger 62, as shown at 73A in FIG. 7, and as will be understood from the foregoing description of the first embodiment of the invention. When the mudline hanger and mudline housing are so disposed at the mudline, the tieback tool is releasably connected to the hanger by lowering of the sleeve 75 from its upper position (not shown) to the lower position connecting the threads 77 and 78 upon rotation of the torque tool 79 in a right-hand direction.

With their adjacent ends interfitted in the manner shown, the tieback tool and mudline hanger are connected to one another by means of a sleeve 75 having right-hand threads 76 about its lower end connected to right-hand threads 77 within the bore 78 of the sub, as shown in FIGS. 6 and 7. As shown in FIG. 8, and as will be better understood from the detailed description of the first embodiment, a torque tool 79 is lowered on drill pipe 80 through the wellhead housing and inner casing string to cause an outwardly spring-pressed lug 81 on its outer side to engage within a slot 82 formed about the bore of the sleeve of the tieback tool. Thus, as previously described in connection with this second embodiment of the invention, the sleeve 75 carried within the bores of the tieback tool and mudline hanger has been rotated and lowered into connection with the hanger from an upper position (not shown) to its lower connected position.

As previously described, the wellhead housing is made up with the upper end of the inner and outer casing strings when they have been lowered to the positions shown. The mudline hanger and lower portion of the inner casing string suspended from it may be lowered into the conductor casing, along with the outer casing string by means of a running string connected to the hanger which supports the inner from the outer string and having left-hand threads 90 connected to the left-hand threads of the hanger, as in the case of the backout sub of the first embodiment. This tool may be of the construction previously described in connection with the first embodiment of the invention or of more conventional construction. Upon right-hand rotation of the running string, the tool is disconnected from the hanger, and the tieback back string may be lowered into connection with the hanger by means on the tieback tool and its right-hand threads adapted to be made up with those of the hanger.

As previously described, since the tie-back string can be connected to the mudline hanger without rotation, it is not necessary to rotate the wellhead 61 out of a predetermined rotational orientation resulting from its landing on the upper end of the conductor. Consequently, a tubing hanger (not shown) from which two or more parallel strings of tubing are suspended may be landed in the bore of the wellhead housing in a predetermined orientation by the engagement of a pin about the outer diameter of the hanger with a slot 80 in the housing, as shown in FIG. 6.

As will be appreciated from the foregoing, the upper end of the mudline hanger 62 of this embodiment of the invention is identical with or at least similar to the "backout sub" of the prior described embodiment of the invention in that it has both right-hand threads and left-hand threads formed in its bore, with the left-hand threads being formed above and in a larger diameter portion of the bore than the right-hand threads.

5–20

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Well apparatus, comprising a lower tubular member connectible at its lower end to a lower well pipe and having vertically spaced, right- and left-hand sets of threads within its bore, an upper tubular member connectible at its upper end to an upper well pipe, means about the upper end of the lower member for sealably interfitting with means about the lower end of the upper member, when the members are moved into end-to-end relation, and a sleeve received within the bores of the upper and lower tubular members to form a continuation thereof and being rotatable and vertically reciprocable with respect thereto, said sleeve having threads thereabout which permit it to be selectively connected to or disconnected from one set of threads of the lower tubular member as it is moved from one vertical position to another.

2. Well apparatus as set forth in claim 1, including a torque tool adapted to be connected to a string of drill pipe for vertical movement through the upper well pipe into engagement with the sleeve in order to impart rotation thereto, whereby the sleeve may be connected to or disconnected said one set of threads, and out of engagement with the sleeve to permit it to be raised therefrom when the sleeve has been so moved.

3. Well apparatus as set forth in claim 2, wherein the sleeve has an essentially vertical slot about its bore, and the tool has a lug slidably engageable with and disengageable from within the slot of the sleeve in response to its vertical movement.

4. Well apparatus as set forth in claim 1, wherein the threads on the sleeve are left hand and one set of threads of the lower tubular member are left-hand to permit disconnection of the sleeve in response to right-hand rotation.

5. Well apparatus as set forth in claim 1, wherein the threads of the sleeve are right hand and the one set of threads of the lower tubular member are right-hand to permit connection of the sleeve in response to right-hand rotation.

6. Well apparatus, comprising a lower tubular member connectible at its lower end to the upper end of a lower well pipe and having vertically spaced left- and right-hand threads within its bore, a first upper tubular member connectible at its upper end to a first upper well pipe and having means on the lower end of its bore for sealably interfitting with means on the upper end of the bore of the lower tubular members as they are moved into end to end relation, a first sleeve carried within the bore of the first upper tubular member for relative rotation and vertical reciprocation with respect thereto between upper and lower positions and having left-hand threads thereabout connectible to the left-hand threads of the lower tubular member, when in its lower position, but adapted to be disconnected therefrom, upon raising of the first upper member and rotation of the first sleeve in a right-hand direction, a second upper tubular member connectible at its upper end to a second upper well pipe and having means on the lower end of its bore for sealably interfitting with said means on the upper end of the bore of the lower tubular member as they are moved into end-to-end relation, upon removal of the first upper tubular member, and a second sleeve carried within the bore of the second upper tubular member for relative rotation and vertical reciprocation with respect thereto between upper and lower positions and having right-hand threads thereabout connectible to the right-hand threads of the lower tubular member upon lowering of the second upper tubular member and rotation of the second sleeve in a right-hand direction to move it from its upper to its lower position.

7. Well apparatus as set forth in claim 6, wherein the tubular members are of the same construction, and each of the first and second sleeves is releasable from the tubular member in which it is carried.

8. Well apparatus as wet forth in claim 1, wherein each sleeve has an essentially vertical slot about its bore, and including a torque tool adapted to be lowered on a string of drill pipe for lowering through upper well pipe into and out of the bore of each sleeve and having a lug slidably engageable within the slot of each sleeve, when so disposed, to permit the sleeve to be rotated.

9. Well apparatus, comprising a sub connectible at its lower end to the upper end of a lower portion of a casing string and having vertically spaced left- and right-hand threads about is bore, a running tool connectible at its upper end to the lower end of an upper portion of the casing string and having a lower end vertically slidably engageable with the upper end of the sub to seal between them, a first sleeve carried within the running tool for relative rotation and vertical reciprocation with respect thereto between upper and lower positions and having left-hand threads thereabout connectible to the left-hand threads of the sub, when in its lower position, but adapted to be disconnected therefrom, upon rotation of the first sleeve in a right-hand direction, whereby said first sleeve may be raised with the running tool from the sub and upper portion of the casing string, a tieback tool connectible at its upper end to the lower end of a replacement upper portion of the casing string and having a lower end vertically slidably engageable with the upper end of the sub to seal between them, upon removal of the running tool, and a second sleeve carried within the tieback tool for relative rotation and vertical reciprocation with respect thereto between upper and lower positions and having right-hand threads thereabout connectible to the right-hand threads of the sub, upon lowering of the tieback tool into engagement with the sub and rotation of the second sleeve in a right-hand direction to move it from its upper to its lower position.

10. Well apparatus as set forth in claim 9, wherein the running tool and tieback tool are of the same construction, and each of the first and second sleeves is releasable from the tool in which it is carried.

11. Well apparatus as set forth in claim 9, wherein each sleeve has an essentially vertical slot about its bore, and including a torque tool connectible to a string of drill pipe for lowering and raising through each of the upper and replacement upper portions of the casing into and out of the bore of each sleeve and having a lug slidably engageable within the slot of each sleeve, when so disposed, to permit the sleeve to be rotated with the drill pipe.

12. Well apparatus, comprising a mudline hanger including a sub connectible at its lower end to an inner casing string to suspend it within an outer casing string within a subsea well bore and having vertically spaced right- and left-hand threads within its bore, whereby the inner casing and hanger may be lowered into suspended position by means of a running tool releasably connectible to the left-hand threads of the sub, a tieback tool connectible, upon renewal of the running tool, to the lower end of a tieback pipe string which is adapted to be connected to a wellhead housing in which a tubing hanger for suspending one or more tubing strings within the inner casing string is to be supported in a predetermined, rotational orientation, means on the lower end of the tieback tool which, upon lowering of the tieback tool, is adapted to sealably interfit with the upper end of the hanger sub when the tool is lowered into end-to-end relation with the sub, and a sleeve carried within the tieback tool for relative rotation and vertical reciprocation with respect thereto between upper and lower positions and having right-hand threads thereabout connectible to the right-hand threads of the sub, upon lowering of the tieback tool into engagement with the sub and rotation of the sleeve in a right-hand direction to move it from its upper to its lower position.

13. Well apparatus as set forth in claim 12, wherein the sleeve has an essentially vertical slot about its bore, and including a torque tool connectible to a string of drill pipe for lowering and raising through the tieback string into and out of the bore of the sleeve and having a lug slidably engageable within the slot of the sleeve, when so disposed, to permit the sleeve to be rotated with the drill pipe.

* * * * *